US006701977B2

(12) United States Patent
Taylor et al.

(10) Patent No.: US 6,701,977 B2
(45) Date of Patent: Mar. 9, 2004

(54) TINTING MACHINE FOR COATING COMPOSITIONS, ESPECIALLY PAINTS

(75) Inventors: Celia Charlotte Taylor, Slough (GB); Ian David Oakes, Burghfield Common (GB)

(73) Assignee: Imperial Chemical Industries, PLC (GB)

( * ) Notice: Subject to any disclaimer, the term of this patent is extended or adjusted under 35 U.S.C. 154(b) by 0 days.

(21) Appl. No.: 10/024,938

(22) Filed: Dec. 19, 2001

(65) Prior Publication Data

US 2003/0019537 A1 Jan. 30, 2003

(30) Foreign Application Priority Data

Jul. 25, 2001 (GB) ..... 0118085

(51) Int. Cl.[7] ..... B65B 1/30
(52) U.S. Cl. ..... 141/83; 141/9; 141/104
(58) Field of Search ..... 141/9, 18, 83, 141/94, 100, 104, 192; 222/52, 77

(56) References Cited

U.S. PATENT DOCUMENTS

| | | | |
|---|---|---|---|
| 4,836,685 | A | 6/1989 | Verreault |
| 5,268,849 | A | 12/1993 | Howlett |
| 6,053,218 | A | 4/2000 | Boers |

FOREIGN PATENT DOCUMENTS

| | | | |
|---|---|---|---|
| EP | 0 099 252 | A | 1/1984 |
| EP | 0 391 286 | A1 | 10/1990 |
| WO | WO 99/11474 | A1 | 3/1999 |

*Primary Examiner*—Gregory L. Huson
*Assistant Examiner*—Peter deVore
(74) *Attorney, Agent, or Firm*—Kenneth J. Stachel

(57) ABSTRACT

A tinting machine system for tinting base paints (2) supplied in containers (1) which paints are suitable for use in coating compositions, which system has a) storage capacity (10) for colorant (11)

Figure 1:
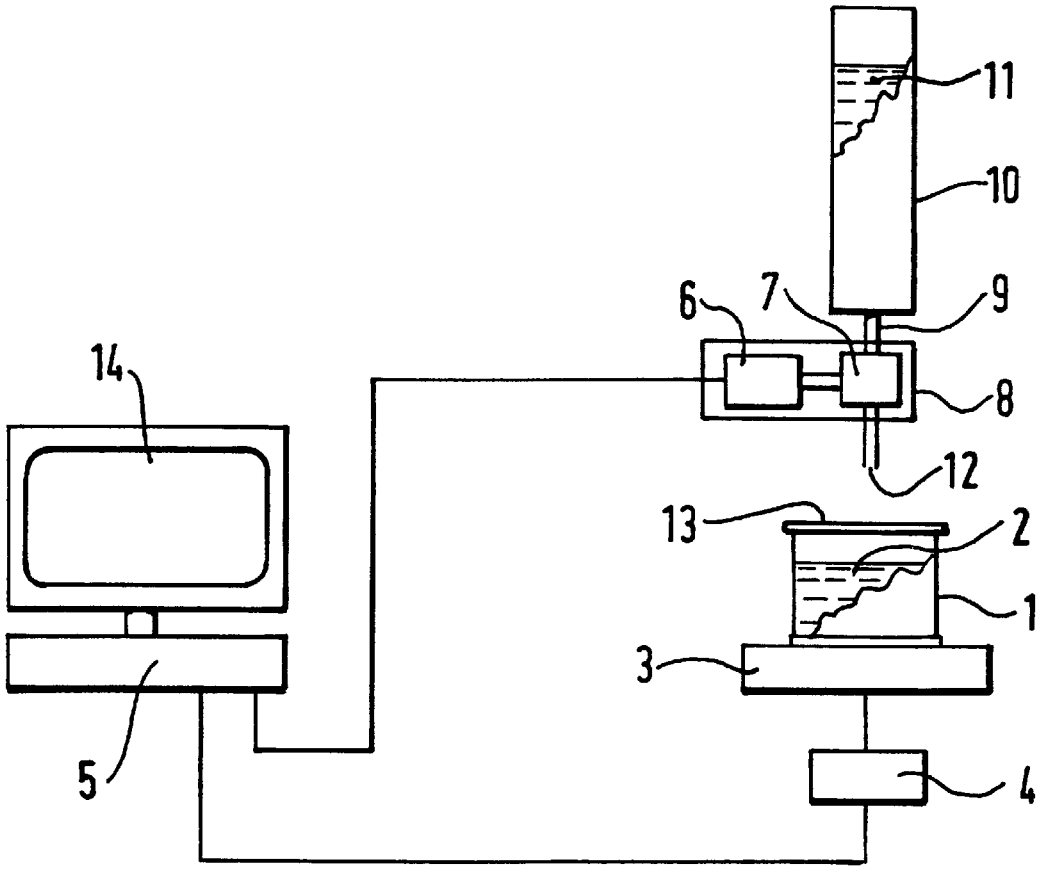

b) accommodation for the container of base paint c) at least one colorant dispenser (8) and d) a collection of color recipes wherein the system also has e) weighing means (3) for weighing the container of tinted coating composition f) signalling means (4) for signalling the weight of a container of tinted coating composition from the weighing means to the processing means g) processing means (5) able to compare a correct weight stored in the collection of color recipes with a signalled weight and h) means for signalling if the weight of the container of tinted coating composition matches, alternatively fails to match, the corresponding weight stored in the collection of color recipes.

14 Claims, 1 Drawing Sheet

TINTING MACHINE FOR COATING COMPOSITIONS, ESPECIALLY PAINTS

This invention relates to tinting machines for coating compositions, especially paints.

Paint is used by both the skilled professional decorator and the relatively unskilled do-it-yourself painter for a variety of reasons. Typically, these are to brighten up the surroundings and/or to match the colour of a particular item of furniture, floor or wall covering. As consumers have become increasingly sophisticated and individual in their choice of colours, the demand for a wider range of colours has also increased. This presents a problem to the paint manufacturer and the retailer as the former has to produce many colours in small amounts, thus losing the economies of scale and, of course the retailer has to provide additional space to store and display this plurality of coloured paints.

Some paint suppliers have addressed this problem by developing tinting machines. These operate on the basis that a variety of colours can be made by adding to a factory produced base paint further colorant, at the retailer's premises. A small number of different coloured base paints, comprising three or four spanning the range of light to deep shades, is provided by the supplier to the retailer, in cans. Such a base paint is unfinished from the point of view of the final colour.

The further colorant to be added is usually in the form of pigment concentrates, tinters or dyes. Usually, about twenty such colorants are required to produce the full colour range of paints, although only three or four are normally required to produce any given colour. The colorants are added to the base paint according to a predetermined recipe, being one of many, stored in a computer. The recipe also indicates which of the base paints should be selected for tinting in order to produce the required colour.

Such tinting machines typically comprise a number of storage vessels containing the colorants, a means of delivering the colorant to the can of base paint, for example by one or more manual or automated pumps, storage means for the collection of recipes and control means (manual and/or computerised) for controlling the delivery of colorant in accordance with the selected recipe. The control means may for example control the addition of colorant by governing the traverse of pistons in pumps or by activating the pumps for a predetermined time period so that a predetermined volume of colorant is delivered in accordance with the recipe for the selected colour. In this way varying amounts of each colorant may be added to the selected base paint enabling paints of a variety of alternative colours to be produced. Finally, the base paint and added colorant are subjected to mixing, usually by intense shaking, to obtain a homogeneous mixture of base paint and colorant with even colour.

The problem with such tinting machines, however is that the actual colour of the final paint depends critically on the amount of each of the colorants added to the base paint. For example, where a colorant is added using a pump driven by a motor the number of turns or steps of the motor relates to a quantity of colorant to be added. This relationship is determined by measurements taken at the time of assembly of the machine and is used to calibrate the pumps. However, for various reasons, this calibration can change over time. For example, because pigments are generally very hard materials, the pump mechanism will wear with use, resulting in additions being made which are not in accordance with the recipe. Even when the pumps are operating correctly the incorrect amount of colorants may be added, if, for example the nozzles through which the colorants exit into the can of base paint are partially or fully blocked. This results in a mis-tint causing the resulting paint to be other than the specified colour and consequently discarded. Even worse is when the variation from the recipe is small and the mis-tint passes unnoticed until the paint has been applied. This inevitably requires a surface to be repainted with the intended colour causing additional expense and inconvenience. Other causes of mistinting are many and include defective pumps, leaky pipework and empty tinter vessels.

Since the tinting machines are designed to produce many different colours, it is very difficult for the operator to recognise simply by looking at the most recently mixed paint when a particular colour has been incorrectly tinted. Consequently, many colours may be mis-tinted before it comes to the operator's attention.

It is an object of this invention to provide an improved tinting machine system that automatically detects mis-tints and alerts the operator.

Accordingly, this invention provides a tinting machine system for tinting base paints supplied in containers which paints are suitable for use in coating compositions, which system has a) storage capacity for colorant
b) accommodation for the container of base paint
c) at least one colorant dispenser and
d) a collection of colour recipes wherein the system also has e) weighing means for weighing the container of tinted coating compositions
f) signalling means for signalling the weight of a container of tinted coating composition from the weighing means to the processing means
g) processing means able to compare a correct weight stored in the collection of colour recipes with a signalled weight and
h) means for signalling if the weight of the container of tinted coating composition matches, alternatively fails to match, the corresponding weight stored in the collection of colour recipes.

Suitable examples of weighing means for weighing the container of tinted coating composition include mechanical balances and load cells. A load cell is a device which produces an output signal proportional to the applied weight or force, when that weight or force is within the range of operation of the device. Load cells are preferred as they are better able to register a wide range of weights accurately. This is important in detecting mis-tints of colours, such colours ranging from light colours, requiring a small addition of colorant to the base paint, to deep colours, typically requiring significantly more colorant to be added.

The signalling means for signalling the weight of the container adapts the input from the weighing means to a signal that is readable by the processing means. This signal provided to the processing means by the signalling means may be of various types, including electrical, optical or radio wave. Such signals may be in analogue or digital format. The digital format is preferred as the processing means' conveniently available usually operate in digital format themselves, and therefore suitable signalling means may include an analogue to digital converter.

Depending on the nature of the signal provided by the signalling means, the signal may be transmitted through electrically conducting wires, fibre-optic wires or air. Transmission through electrically conducting wire is preferred. More preferably the signal is transmitted through fibre-optic wire as it is less likely to suffer interference from extraneous sources.

The processing means may be a device comprising in combination, storage means capable of storing the collection of colour recipes and comparitor means for comparing the signalled weight to the recipe of the selected colour. The processing means may be provided by a personal computer, be it a desk top or lap top version, a hand held computer or a server. The processing means may communicate with the associated parts of the tinting machine system via the internet, direct telephone, cable or other connection. The processing means may be remote from or local to the said parts.

The means for signalling may be activated when the weight of the container of tinted coating composition does not agree with the corresponding weight in the collection of stored colour recipes. Alternatively and additionally, it may be activated when the weight is in accordance with the corresponding weight in the colour recipe. In either case a signal is provided to alert the operator indicating whether or not the signalled weight matches the corresponding weight of the colour recipe within pre-determined limits. The pre-determined limits may vary according to the colour of the tinted coating composition.

The means for signalling may include audible devices such as buzzers, bells and whistles or can be visual such as a light or a warning message displayed on a user interface such as a visual display unit or TV monitor.

For each colour offered, the colour recipe includes information indicating which base paint to select for tinting, the amount of each colorant addition to be made and the final weight of the container of tinted paint. The amount of colorant addition may be by weight or volume. The colours may be identified by name, code or cypher or combinations thereof, for example British Standard or RAL names or codes, NCS (Natural Colour System), NCS2, "Pantone" references or "Dulux" "Colour Palette" cyphers.

The collection of colour recipes can be recorded in various forms including a compilation or a database. Preferably they are recorded systematically or methodically and are individually accessible to form a database which enables additions and deletions to be more readily made. The collection of recipes may be stored on storage means, suitable examples of which include magnetic floppy disks or hard disks; optical disks such as a CD ROM and Digital Versatile Disk (DVD). The storage means may be local to or remote from the processing means.

Suitable colorants include pigments, pigment concentrates and dyes. Pigment concentrates generally comprise high levels of pigment, dispersed in a carrier liquid, optionally with the aid of dispersant. The carrier liquid may be an organic solvent or water or mixtures thereof. Solutions of dyes in appropriate solvents or undiluted dyes are also useful. Pigment concentrates are preferred as they provide better hiding power than dyes.

The base paint comprises all the necessary components of a coating composition including pigment, binder, carrier liquid, solvent, dispersant, antifoam, coalescing aid and other additives typically found in coating compositions. The base paint is distinguished from the final tinted coating composition mainly because it does not contain all of the required colorants to produce a specified colour contained in the collection of colour recipes.

The number of base paints required is generally from 3 to 8. Preferably from 4 to 6 are used as this reduces the risk of selecting the wrong base paint for tinting whilst maintaining acceptable capability in producing the necessary range of colours.

From 9 to 25 colorants are required to produce the range of colours using the base paints. Preferably from 12 to 16 are used as this results in a simpler tinting machine.

Storage capacity for the colorants can be provided by vessels, typically contained within the tinting machine for convenience.

The tinting machine provides accommodation for the container of base paint to be situated whilst the colorant is added. This can be, for example, a shelf. Preferably the accommodation should be of sufficient size to accommodate the weighing means and the container together. This allows the addition of colorant and subsequent weighing of the tinted coated composition in a single operation.

The addition of colorant to the base paint is carried out using the colorant dispenser. Suitable examples of a colorant dispenser include a pump driven by a motor or a syringe driven by a motor. Stepper motors are preferred as they can be accurately controlled thereby delivering precise quantities of colorant via the pump. Even more preferably, the colorant dispenser is controlled by the processing means.

Where more than one colorant is required to achieve the tinted coating composition the colorants may be added sequentially, one after the other, or together. During dispensing, adding the colorants together is preferred as this is faster. In certain circumstances, however, such as during calibration of the dispensers, it is preferred that the colorants are added one after the other.

It is desirable for each colorant to be added using its own dedicated dispenser as this minimises the risk of contamination of one colorant by another.

The invention also provides a method for detecting errors in a process for tinting coating compositions to obtain a pre-selected colour of coating composition, in which a pre-determined amount of colorant appropriate to the achievement of the pre-selected colour is delivered into a pre-determined type and quantity of a base paint, wherein the weight of the container of base paint when containing the delivered colorant is determined and then compared with a collection of colour recipes of correct corresponding weights for pre-selected colours and a signal is generated if the comparison reveals that the weight matches, alternatively fails to match, the correct weight for that pre-selected colour in that type and quantity of base paint.

The criteria for activating the means for signalling are the same as those discussed in the discussion above relating to the tinting machine system.

A further cause for the colour of the final paint being incorrect is that the operator has selected a container of base paint not in accordance with the stored recipe, rather than the result of an incorrect amount of colorant added. Since the containers of base paints are filled to different levels according to which shade of base paint they contain, each base paint can be distinguished from the others by weight. In addition, the various base paints contain differing amounts of pigments of different density which further contributes to weight differences. Consequently, in a variation of the method for detecting tinting errors, the tinting machine system of the invention can also be used to detect whether or not the weight of the container of base paint matches the corresponding weight stored in the collection of colour recipes, before colorant addition begins.

Accordingly, this invention provides a method for detecting errors in the selection of base paint for tinting in a tinting machine system, wherein the weight of the container of base paint is determined and then compared with a collection of colour recipes of correct corresponding weights for pre-selected colours and a signal is generated if the comparison reveals that the weight matches, alternatively fails to match, the correct weight for that type and quantity of base paint The invention is further illustrated by the following preferred embodiment described with reference to the drawing of which FIG. 1 is a diagrammatic representation of a tinting machine system.

FIG. 1 shows a container (1) part cut away to reveal that it is almost fully filled with base paint (2) situated on a load cell (3). The load cell is connected to an analogue to digital converter (ADC) (4), which signals in digital format any weight registered by the load cell to a computerised processing means (5). The computerised processing means has stored on its hard disk a collection of recipes in the form of a database. The computerised processing means also communicates with a stepper motor (6) that drives a pump (7), the combination being the colorant dispenser (8). This communicates via pipework (9) with a storage vessel (10) containing colorant (11). Only one storage vessel is shown for simplicity although in practice a multiplicity of colorants are provided as discussed above. Exit (12) of the storage vessel is located vertically above open mouth (13) of the container so that additions of colorant can be conveniently made to the base paint. The computerised processing means is further connected to a video display unit (14) to which messages can be signalled and displayed.

What is claimed is:

1. A method suitable for use in small trade stores or retail shops for ensuring that coating compositions have the correct colour in which a) a can containing base paint is placed on weighing means, b) colourants are simultaneously dispensed into the can, c) a load on the weighing means is determined wherein d) the load is compared with data in a database, each datum being a correct load for a particular colour for the coating composition, e) the absence of a match between the load and a datum in the database is detected and optionally f) an alarm is sounded or the can and contents are rejected if the absence of a match is detected.

2. A method according to claim 1 wherein at e) the presence of a match between the load and the datum in the database is detected and optionally an alarm is sounded.

3. A method according to claim 2 wherein the load is determined using a load cell.

4. A method according to claim 1 wherein the load is determined using a load cell.

5. The method according to claim 1 wherein the method is used to detect whether or not the correct base paint has been selected for tinting in which a) a can containing base paint is placed on weighing means b) a load due to the base paint is determined and compared to the correct load of base paint in the database for the selected colour c) the absence of a match between the determined load and the correct load is detected and an alarm sounded.

6. A tinting machine system suitable for use in small trade stores or retail shops and capable of ensuring that coating compositions coloured using the tinting machine system have the correct colour in which the tinting machine system includes a) weighing means on which an open can of coating composition can be located and which is able to determine the load on the weighing means, b) reservoirs for containing colourants, c) positive displacement means for delivering a plurality of colourants simultaneously from reservoirs into the can, wherein the tinting machine system also includes d) processing means having storage means in which is stored a database in which each datum is a correct load for a particular colour for the coating composition, e) processing means having a comparitor for comparing the load after delivery of the colourants into the can with data in the database, f) means for signaling the absence of a match between the load and a datum in the database and optionally g) an alarm or rejection means which is activated when there is an absence of a match.

7. A tinting machine system according to claim 6 wherein the weighing means is a load cell.

8. A tinting machine system according to claim 7 wherein the positive displacement means is a piston pump.

9. A tinting machine system according to claim 6 wherein the positive displacement means is a piston pump.

10. A tinting machine system according to any one of claims 9 wherein the processing means is a computer.

11. A tinting machine system according to claim 9 wherein the processing means is located remotely from associated parts of the tinting machine system.

12. A tinting machine system according to any one of claims 6 wherein the processing means is a computer.

13. A tinting machine system according to claim 12 wherein the processing means communicates from a remote location to the associated parts of the tinting machine system via the internet, direct telephone, cable or other connection.

14. A tinting machine system according to claim 6 wherein the processing means is located remotely from associated parts of the tinting machine system.

* * * * *